US005979952A

United States Patent [19]

Dering et al.

[11] Patent Number: 5,979,952

[45] Date of Patent: Nov. 9, 1999

[54] MECHANISM FOR ALIGNING A STRIKER WITH AN AUTOMOTIVE DOOR LATCH

[75] Inventors: Timothy A. Dering, Rochester Hills; Joseph G. Contos, Plymouth; Dennis M. Steward, Berkley, all of Mich.

[73] Assignee: Chrysler Corporation, Auburn Hills, Mich.

[21] Appl. No.: 09/092,598

[22] Filed: Jun. 5, 1998

[51] Int. Cl.[6] ..... E05B 15/02

[52] U.S. Cl. ..... 292/341.18; 292/DIG. 55; 292/DIG. 60; 29/468

[58] Field of Search ..... 292/341.15, 341.16, 292/341.17, 341.18, DIG. 55, DIG. 60, DIG. 64; 29/464, 468, 407.01, 407.09, 407.1

[56] References Cited

U.S. PATENT DOCUMENTS 5,282,305 2/1994 Nutt et al. ..... 29/468

5,694,675 12/1997 Pasternak et al. ..... 29/468

FOREIGN PATENT DOCUMENTS 54-5276 1/1979 Japan .

60-155328 8/1985 Japan .

778990 11/1980 Russian Federation .

*Primary Examiner*—Steven Meyers

*Assistant Examiner*—John B. Walsh

*Attorney, Agent, or Firm*—Lawerence J. Shurupoff

[57] ABSTRACT

An automotive vehicle latch system is aligned in a single operation without trial-and-error manipulations of the striker. An alignment mechanism is mounted on the vehicle body to align the striker on the vehicle body with the latch on the vehicle door. The alignment mechanism includes an elongated latch sensor having one end attached to a loosely mounted striker and another end adapted to mate with the door latch when the door is moved to a partially closed position. After the latch sensor has been locked in a proper position for alignment of the striker and latch, the door can be opened to allow the striker to be fastened to the vehicle body.

7 Claims, 2 Drawing Sheets

MECHANISM FOR ALIGNING A STRIKER WITH AN AUTOMOTIVE DOOR LATCH

BACKGROUND OF THE INVENTION

1. Field of the Invention

This invention relates to automotive door latches, and particularly to a fixture for aligning a striker on an automotive body with a latch on an associated door, so that the striker can be accurately installed without trial-and-error alignment procedures.

2. Description of Prior Developments

Conventional automotive latch systems often include a striker mounted on the automotive body at an edge of the door opening and a latch mounted in an edge of the door. In order for the latch system to operate correctly, it is necessary that the striker be aligned with the latch at the time the striker is installed.

Typically, the striker includes a mounting plate seated flatwise on an edge wall of a door opening, and a U-shaped rod or roller extending outwardly from said mounting plate so as to be in the path of the latch located on the door. The mounting plate may be secured to the wall of the door opening by one or more screws extendable through vertical slots in the wall for connection with nuts located on the concealed face of the wall. The vertical slots permit the striker to be adjusted vertically so as to be aligned with the latch on the associated door.

The striker alignment operation will sometimes involve securing the striker mounting plate on the fixed wall, then closing the door to ascertain the extent of misalignment, then loosening the mounting plate, and resecuring the plate in a position calculated to correct the misalignment. Some trial and error in repositioning of the plate is usually required. The mounting screws have to be loosened and retightened each time the striker plate is to be repositioned. The process is somewhat time-consuming and not always fully successful.

SUMMARY OF THE INVENTION

The present invention relates to an apparatus and method of aligning the striker with the door latch, wherein the aligning process is accomplished automatically by moving the door to a partially closed position. The aligning apparatus adjusts the striker plate automatically, without human assistance or manipulation of the striker.

In a preferred mechanism embodying the invention, a latch sensor is movably mounted on a carrier that is adapted for fixed positionment on an automotive body. The latch sensor has an inner end fitting adapted to grip the striker while it is loosely mounted on the body, and an outer end fitting adapted to mate with the door latch when the door is moved to a partially closed position.

When the door latch contacts the outer end fitting on the latch sensor, the sensor is deflected up or down on the carrier so that the striker is adjusted in accordance with the deflection. After the sensor is locked to the carrier in the deflected position, the vehicle door is moved to the open position, and the striker is fastened to the vehicle body wall.

The mechanism and method of the present invention are advantageous in that the latch-striker alignment operation is accomplished automatically with a mechanical apparatus, such that alignment accuracy is a function of the mechanism, not the skill or visual perceptiveness of the human operator.

Another advantage is that the alignment operation is completed with a single closure of the vehicle door. It is not necessary to close the door a number of times to obtain the necessary alignment.

A further advantage of the invention is that, since the aligning operation is accomplished with a mechanical apparatus, the human technician is not likely to forget the operation. The presence of the apparatus at the station where the striker is installed serves as a reminder that the striker has to be aligned with the latch and not merely installed.

Further features of the invention will be apparent from the attached drawing and description of an illustrative apparatus constructed according to the invention.

BRIEF DESCRIPTION OF THE DRAWINGS

FIG. 5 is taken on a reduced scale, when compared to the scale used for FIG. 1.

DESCRIPTION OF A PREFERRED EMBODIMENT OF THE INVENTION

Figure 1:
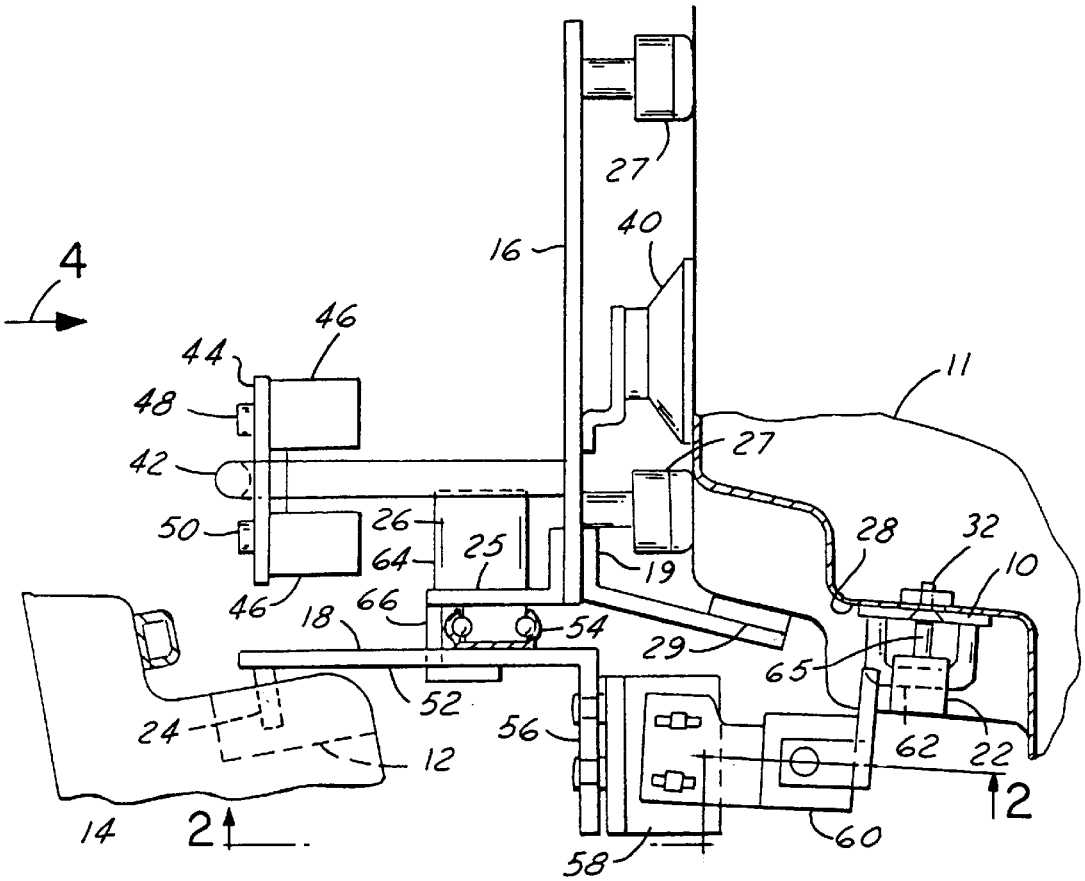
FIG. 1 is a plan view of a striker-latch aligning mechanism constructed according to the invention.

The drawings show a mechanism for aligning a striker 10 on an automotive body 11 with a latch 12 on an associated door 14. The mechanism includes a carrier 16 adapted for removable fixed positionment on the automotive body 11, and a latch sensor 18 movably mounted on carrier 16 for movement in an up-and-down direction, as indicated by arrows 20 in FIGS. 2 and 4.

Figure 5:
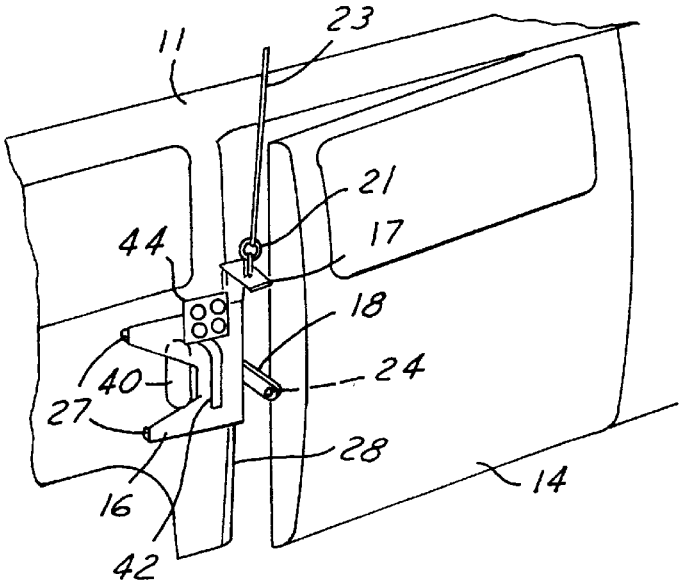
FIG. 5 is a fragmentary perspective view of an automotive vehicle, with the FIG. 1 mechanism positioned thereon to achieve a striker-latch aligning operation.

Latch sensor 18 has an inner end fitting 22 adapted to grip the loosely mounted striker 10, and an outer end fitting 24 adapted to mate with the door latch 12 when door 14 is in a partially closed position, as depicted in FIGS. 1 and 5. End fitting 24 has the same rod-configuration as striker 10; so that when the door 14 is moved to the FIG. 1 partially closed position, the rod-like end fitting 24 fits into latch 12, in a fashion generally similar to the fit of striker 10 in the latch when the door is in the fully closed condition, i.e. during normal use of the vehicle.

The rod-like end fitting 24 acts as a simulated striker that can readily fit into the latch opening in latch 12. In order for end fitting 24 to fit into the latch opening it may be necessary for the technician to move latch sensor 18 up or down, in accordance with variations in latch elevation, i.e. variations in elevation due to manufacturing tolerances in the door or door hinges. The human operator can manipulate sensor 18 up or down to enable end fitting 24 to enter into the latch opening. The position of sensor 18 when end fitting 24 is in the door latch can be considered as the deflected position.

A locking assembly 26 is mounted on carrier 16 for locking the latch sensor 18 to the carrier when the rod-type end fitting 24 is seated in the door latch 12, as shown in FIG. 1. With latch sensor 18 locked to carrier 16, the door 14 can be swung to the open position (separated from sensor 18) without affecting the position of sensor 18. The locking assembly 26 holds the latch sensor in the deflected or adjusted position.

Striker 10 is initially in a loose condition in which it can shift up or down on wall 28 with the attached latch sensor 18. End fitting 22 at the inner end of latch sensor 18 includes two opposed jaws 30 adapted to close against striker 10, so that the striker is affixed to the sensor 18 when the sensor is manipulated to cause end fitting 24 to fit into latch 12 in the partially closed position of the door. Sensor 18 thus serves as a horizontal extension of the striker 10 and emulates the position of the striker at a position displaced from the striker.

After the door has been swung to the open condition, the mounting screws 32 for the striker can be tightened into the nuts behind wall 28 to fasten the striker in a fixed position on wall 28. The screw-tightening operation is performed while the sensor 18 is supporting the striker in a position horizontally aligned with door latch 12.

When the striker has been fastened to wall 28, the jaws 30 can be opened to separate the striker from sensor 18. Also, locking assembly 26 can be moved to the unlocked condition, to return sensor 18 to its freely slipping floating condition on carrier 16. The entire striker aligning mechanism can thereafter be removed from the automotive body 11 for subsequent usage on another vehicle.

The various components of the aligning mechanism can be constructed in various ways. As shown in the drawings, carrier 16 includes an upright vertical plate 17 having a suspension bracket 19 at its upper end equipped with a lifting eye 21. An overhead reel (not shown) has a cable 23 (FIG. 5) extending downwardly to connect with eye 21, such that the aligning mechanism is supported while at the same time being capable of manual movement toward or away from the side of an automotive vehicle.

Carrier plate 16 mounts a second flanged plate 25 that extends forwardly, as shown in FIG. 1. The aforementioned locking assembly 26 is mounted on plate 25.

A positioner is provided for orienting carrier 16 in a desired position on the automotive body 11. In the illustrated mechanism the positioner includes four rubber-tipped bumpers 27 extending from the rear face of plate 17, to contact the outer surface of the vehicle body. The positioner further includes a lower pad 29 extending at an angle from plate 17 so as to abut vehicle body wall 28 below striker 10, and an upper pad 31 extending at an angle from bracket 19 so as to abut vehicle body wall 28 above striker 10.

Bumpers 27 orient carrier 16 relative to the outer surface of the vehicle body. Pads 29 and 31 orient carrier 16 relative to the wall 28 that defines the door opening. The bumpers and pads collectively position the carrier so that end fitting 22 on the inner end of latch sensor 18 is properly oriented for gripping striker 10 in the desired fashion.

The construction and location of the bumpers and pads is dictated by the vehicle body design and surface configuration. Each vehicle body design requires a specific bumper-pad arrangement.

In the preferred striker-latch alignment mechanism, carrier 16 is removably fixed to the outer surface of the vehicle body by a single suction cup 40 suitably mounted to the rear face of carrier plate 17. A pneumatic passage system is provided for achieving a vacuum within the suction cup, so that the cup serves as a mechanism for retaining the carrier 16 in a fixed position on the vehicle body. A manual vent system is included in the pneumatic passage system for removing the vacuum force within the suction cup, so that the vacuum cup is releasable from the vehicle surface, e.g. when the aligning mechanism is to be used on another vehicle.

Carrier 16 is equipped with a handle 42 that permits the mechanism to be lifted and moved laterally to achieve a desired position on the vehicle body. As noted previously, the weight of the mechanism is carried by the suspension cable 23 to minimize the work required of the human technician.

Figure 4:
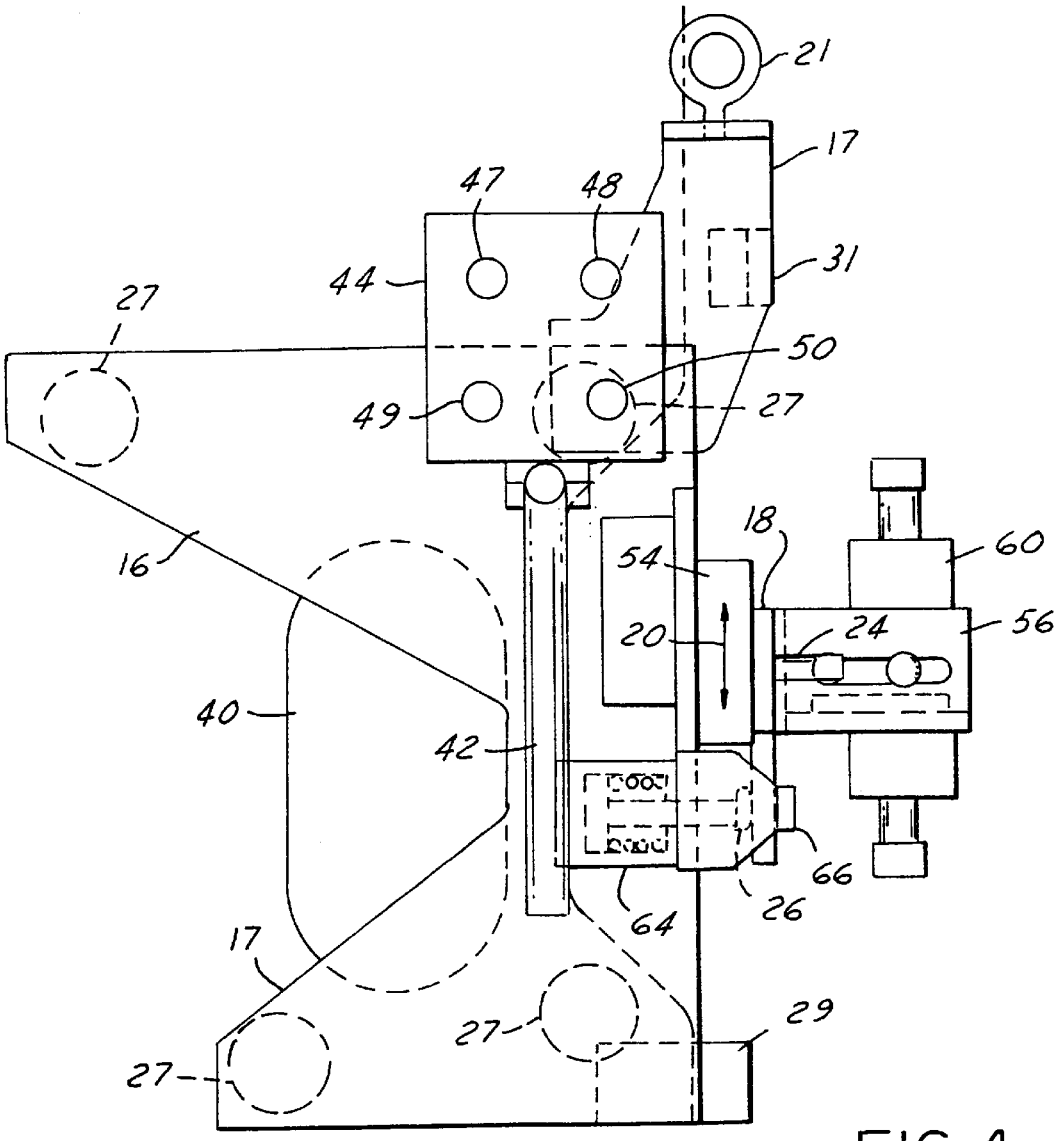
FIG. 4 is a front elevational view of the FIG. 1 mechanism, looking in the direction of arrow 4 in FIG. 1.

A control panel 44 is located on the carrier 16 above handle 42 for supporting four pneumatic valves 46 in the space behind the control panel. Each pneumatic valve is equipped with a manual push button actuator accessible from the area in front of the control panel. The push buttons are referenced by numerals 47, 48, 49, and 50 (FIG. 4).

The valve controlled by push button 47 is connected to the pneumatic system that provides a vacuum force within suction cup 40. The valve controlled by push button 48 controls the flow of pneumatic fluid for operating the actuator that moves jaws 30 to the closed position on a striker 10. The valve controlled by push button 49 controls the flow of pneumatic fluid for operating locking assembly 26 to the locked condition wherein sensor 18 is locked to carrier 16. The valve controlled by push button 50 acts as a vent for the pneumatic systems controlled by push buttons 47, 48 and 49. Push button 50 thus cancels the effects of the other push buttons on their respective pneumatic systems.

The illustrated system requires an external vacuum source and external compressed air source. The pneumatic components of the system are connected together by flexible plastic tubing. The pressure and vacuum connections to the respective sources are preferably made at the control panel 44.

The various push buttons on the control panel are manually operated at various different times in the operational cycle. Button 47 is pushed when it is desired to activate suction cup 40, i.e. when it is desired to attach carrier 16 to the vehicle body. Button 48 is pushed when it is desired to close jaws 30 on striker 10. Button 49 is operated when it is desired to lock the latch sensor 18 in a deflected position on carrier 16. Button 50 is operated when it is desired to return the three pneumatically-controlled devices 40, 30 and 26 to their inactive standby conditions, e.g. at the end of the operational cycle.

Latch sensor 18 can be constructed in various ways. As shown in the drawing, the latch sensor includes a plate-like sensor body 52 extending alongside carrier wall 25. A vertical guide assembly 54 is connected to plate 52 and wall 25 to permit plate 52 to move vertically (up and down) on carrier 16, as denoted by arrows 20 in FIGS. 2 and 4.

Latch sensor 18 further includes a wall 56 extending at a right angle from plate 52 for slidably supporting a carriage 58 for horizontal motion toward or away from striker 10. Carriage 58 supports a pneumatic actuator 60 for the jaws 30.

Figure 2:
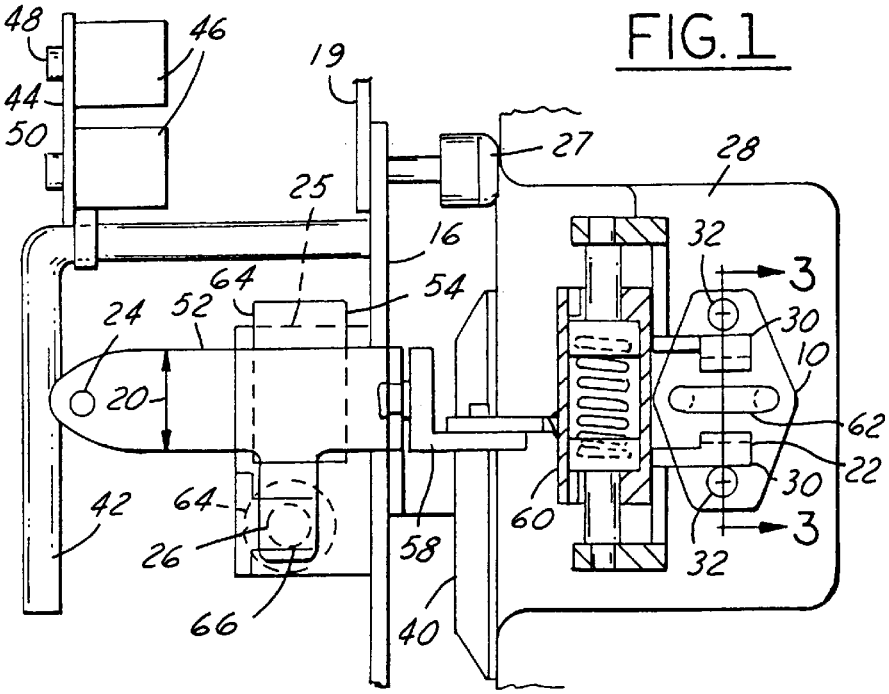
FIG. 2 is a fragmentary side elevational view of the FIG. 1 mechanism, with one component sectioned along line 2—2 in FIG. 1.
Figure 3:
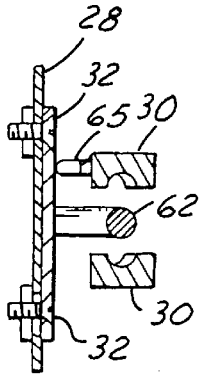
FIG. 3 is a fragmentary sectional view taken on line 3—3 in FIG. 2.

As shown in FIGS. 2 and 3, the jaws are opened so as to be out of contact with striker 10. When compressed air is supplied to pneumatic actuator 60 the two jaws 30 are moved toward each other to grip rod portion 62 of the striker. The loosely mounted striker will shift slightly along vehicle wall 26 to a centered position in jaws 30. The U-shaped rod portion of the striker will then be aligned horizontally with the rod-type end fitting 24 on the outer end of sensor body 52. The sensor acts as a horizontal extension of the striker during the alignment process. After the alignment process is accomplished, the pneumatic actuator 60 is vented so that the internal spring in the actuator returns jaws 30 to the open condition, as shown in FIGS. 2 and 3.

Pneumatic actuator 60 is controlled by the push buttons 48 and 50. Button 48 is operated to pressurize the actuator. Button 50 is operated to vent the actuator.

Carriage 58 ensures that jaws 30 will be aligned with rod portion 62 of the striker. In some cases the striker may be shifted away from wall 28 due to the presence of a shim between the striker mounting plate and vehicle wall 28. Also, manufacturing tolerances can cause slight variations in the location of rod portion 62. Carriage 58 allows jaws 30 to be aligned with the striker in spite of minor variations in striker positionment. A probe 65 extends from one of the jaws for engagement with the striker mounting plate, whereby the jaws 30 are aligned with rod portion 62 of the striker.

As previously noted, there is a locking assembly 26 for releasably locking the latch sensor 18 to carrier 16. The locking assembly includes a pneumatic actuator 64 mounted on carrier wall 25. A flange 66 on wall 25 extends around an edge of sensor body 52 and alongside the sensor body opposite face to form an abutment. The pneumatic actuator 64 includes a piston that moves rightwardly (FIG. 4) when pneumatic fluid is supplied to the right end of the actuator. The piston exerts a lock force on sensor body 52, such that the sensor is squeezed between the piston and the abutment 66. When actuator 64 is vented, an internal spring in the actuator returns the piston leftwardly to an unlocking condition.

Actuator 64 is controlled by push buttons 49 and 50. A manual push on button 49 pressurizes the actuator. A manual push on button 50 vents the actuator.

The alignment mechanism is controlled by the four push buttons 47, 48, 49 and 50 on control panel 44. In a typical alignment operation the carrier is placed on the vehicle body in a fixed position dictated by bumpers 27 and the two positioning pads 29 and 31. The operator grips handle 42 while at the same time punching button 47 to actuate suction cup 40. Thereafter the carrier 16 is held in place by the suction cup, freeing the technicians hands for controlling the alignment operation. The technician stands outside the vehicle facing the carrier 16.

The operator moves carriage 58 so that jaws 30 are aligned with the striker, as shown in FIGS. 2 and 3. Button 48 is pushed to activate actuator 60, thereby closing jaws 30 on the striker. At this time the striker is loosely mounted on vehicle wall 28 so that the striker can shift slightly in the vertical direction to a centered position in jaws 30.

The vehicle door 14 is then moved to the partially closed position (as shown in FIGS. 1 and 5), so that rod-type end fitting 24 enters into the door latch. Latch sensor 18 is moved slightly up or down, such that striker 10 will be in horizontal alignment with the latch even though there is no direct contact between the striker and the latch.

With door 14 in the partially closed position, the operator pushes button 49 to activate the pneumatic actuator 64. Locking assembly 26 is thereby operated to the locking position, wherein latch sensor body 52 is locked to carrier 16. The door 14 is then moved to the open position so that the operator can reach into the vehicle to fasten the mounting screws for striker 10, usually with a power screw driver suspended alongside the alignment mechanism.

As the final step in the process, push button 50 is pressed to deactivate the suction cup 40, actuator 60 and actuator 64. Handle 42 can be used for removing the mechanism from the vehicle. The entire operation is relatively quick; usually only about fifteen seconds is required to align and fasten the striker.

The drawings show one particular form that the apparatus can take. However, it will be appreciated that the apparatus components can take various forms and configurations while still practicing the invention.

What is claimed:

1. A mechanism for aligning a striker on an automotive body with a latch on an associated door, comprising:

a carrier adapted for removable fixed positionment on the automotive body;

a latch sensor movably mounted on said carrier for up and down movement; said latch sensor having an inner end fitting adapted to grip a loosely mounted striker and an outer end fitting adapted to mate with the door latch when the door is in a partially closed position, such that said sensor is adapted to adjust the striker in accordance with the deflection of said sensor by the latch when the striker is thus gripped by the inner end fitting of said sensor;

means for releasably locking said sensor in its deflected position, to permit the striker to be fastened to the automotive body, wherein said latch sensor comprises a sensor body movably mounted on said carrier for up or down movement, and a carriage movably mounted on said sensor body for horizontal motion toward or away from the striker when said carrier is positioned on the automotive body.

2. The mechanism of claim 1, wherein said inner end fitting comprises two openable jaws on said carriage for gripping the striker.

3. The mechanism of claim 2, and further comprising a pneumatic actuator for operating said jaws between open and closed positions.

4. A mechanism for aligning a striker on an automotive body with a latch on an associated door, comprising:

a carrier adapted for removable fixed positionment on the automotive body;

a latch sensor movably mounted on said carrier for up and down movement; said latch sensor having an inner end fitting adapted to grip a loosely mounted striker and an outer end fitting adapted to mate with the door latch when the door is in a partially closed position, such that said sensor is adapted to adjust the striker in accordance with the deflection of said sensor by the latch when the striker is thus gripped by the inner end fitting of said sensor;

means for releasably locking said sensor in its deflected position, to permit the striker to be fastened to the automotive body, and an overhead suspension cable means connected to said carrier for allowing said carrier to be moved toward or away from the automotive body.

5. A mechanism for aligning a striker on an automotive body with a latch on an associated door, comprising;

a carrier adapted for removable fixed positionment on the automotive body;

a latch sensor movably mounted on said carrier for up and down movement; said latch sensor having an inner end fitting adapted to grip a loosely mounted striker and an outer end fitting adapted to mate with the door latch when the door is in a partially closed position, such that said sensor is adapted to adjust the striker in accordance with the deflection of said sensor by the latch when the striker is thus gripped by the inner end fitting of said sensor;

means for releasably locking said sensor in its deflected position, to permit the striker to be fastened to the automotive body;

said carrier comprising a vertical plate and plural bumpers extending from said plate for engagement with the automotive body, a handle connected to said carrier for manipulating the carrier for movement between a fixed position on the automotive body and a standby position detached from the automotive body, a control panel located above said handle, and multiple push button manual controllers mounted on said control panel.

6. The mechanism of claim 5, where in s aid push button controllers comprise a first push button for retaining said carrier on the automotive body, a second push button for controlling the gripping action of said sensor on the striker, and a third push button for controlling the locking action between the carrier and the sensor.

7. The mechanism of claim 6, wherein said push button controllers comprise a fourth push button for cancelling the effects of said first, second and third push buttons.

* * * * *